US011021281B2

(12) United States Patent
Brizek et al.

(10) Patent No.: US 11,021,281 B2
(45) Date of Patent: Jun. 1, 2021

(54) ORBITAL STRETCH WRAPPING APPARATUS

(71) Applicant: TAB Industries, LLC, Reading, PA (US)

(72) Inventors: Thomas A. Brizek, Reading, PA (US); Andrew G. Brizek, Reading, PA (US)

(73) Assignee: TAB Industries, LLC, Reading, PA (US)

( * ) Notice: Subject to any disclaimer, the term of this patent is extended or adjusted under 35 U.S.C. 154(b) by 168 days.

(21) Appl. No.: 16/037,721

(22) Filed: Jul. 17, 2018

(65) Prior Publication Data

US 2018/0334274 A1 Nov. 22, 2018

Related U.S. Application Data

(63) Continuation of application No. 13/919,132, filed on Jun. 17, 2013, now abandoned.

(60) Provisional application No. 61/661,112, filed on Jun. 18, 2012.

(51) Int. Cl.

| | |
|---|---|
| ***B65B 11/02*** | (2006.01) |
| ***B65B 11/00*** | (2006.01) |
| ***B65B 61/06*** | (2006.01) |

(52) U.S. Cl.

CPC ..... *B65B 11/008* (2013.01); *B65B 11/025* (2013.01); *B65B 61/06* (2013.01); *B65B 2011/002* (2013.01); *B65B 2210/18* (2013.01)

(58) Field of Classification Search

CPC ..... B65B 11/008; B65B 11/025; B65B 2011/002; B65B 2210/18

USPC ..... 53/399, 441, 465, 556, 588, 210

See application file for complete search history.

(56) References Cited

U.S. PATENT DOCUMENTS

| | | | | |
|---|---|---|---|---|
| 3,605,375 | A * | 9/1971 | Marshall | B65B 27/08 53/399 |
| 3,928,939 | A * | 12/1975 | Edwards | B65B 11/04 53/442 |
| 4,008,114 | A * | 2/1977 | Lindsey | B65H 23/063 156/392 |
| 4,077,179 | A * | 3/1978 | Lancaster | B65B 11/045 100/15 |
| 4,299,076 | A | 11/1981 | Humphrey | |
| 4,302,920 | A * | 12/1981 | Lancaster | B65B 11/045 264/288.4 |

(Continued)

OTHER PUBLICATIONS

2008 Brochure for Yellow Jacket 110 Pallet Wrapper.

*Primary Examiner* — Nathaniel C Chukwurah
*Assistant Examiner* — Mobeen Ahmed
(74) *Attorney, Agent, or Firm* — Barley Snyder

(57) ABSTRACT

An orbital stretch wrapping apparatus is provided and includes a base frame, a circular ring mounted on the base frame and rotatable with respect to the base frame about an axis of rotation, a stretch film dispenser mounted on the circular ring and rotatable with the circular ring about the axis of rotation, the stretch film dispenser having a subframe fixed to the circular ring, a roll of stretch film mounted to the subframe and rotatable with respect to the subframe, a first feed roller mounted to the subframe and rotatable with respect to the subframe, a second feed roller mounted to the subframe and rotatable with respect to the subframe, and a brake member connected to the first feed roller and the second feed roller.

11 Claims, 13 Drawing Sheets

(56) References Cited

U.S. PATENT DOCUMENTS 4,317,322 A * 3/1982 Lancaster ..... B65B 11/008 53/399
4,387,548 A * 6/1983 Lancaster ..... A01F 15/071 53/399
4,458,467 A * 7/1984 Shulman ..... B65B 11/045 53/399
4,712,354 A * 12/1987 Lancaster ..... B65B 11/008 53/176
4,723,393 A * 2/1988 Silbernagel ..... B65B 11/008 53/556
4,953,336 A * 9/1990 Lancaster, III ..... B65B 11/008 53/176
5,203,136 A * 4/1993 Thimon ..... B65B 11/045 53/141
5,301,493 A * 4/1994 Chen ..... B65B 11/045 53/556
5,311,725 A * 5/1994 Martin ..... B65B 11/025 53/556
5,414,979 A * 5/1995 Moore ..... B65B 41/16 53/556
5,606,849 A 3/1997 Bettenhausen
5,799,471 A * 9/1998 Chen ..... B65H 23/04 476/47
5,836,140 A * 11/1998 Lancaster, III ..... B65B 11/025 53/399
6,006,498 A * 12/1999 Cleine ..... B65B 11/04 53/441
6,082,081 A * 7/2000 Mucha ..... B65B 11/00 425/66
6,253,532 B1 7/2001 Orpen
6,564,532 B2 5/2003 Gutche
6,651,408 B1 * 11/2003 McClure ..... A01F 15/0715 242/421.2
6,698,161 B1 * 3/2004 Rossi ..... B65B 11/00 53/382.2
6,729,106 B2 * 5/2004 Wiley ..... B65B 11/008 53/399
7,581,368 B1 9/2009 Bison
8,037,660 B2 10/2011 Lancaster, III et al.
9,108,753 B2 * 8/2015 Moore ..... B65B 11/008
9,290,285 B2 * 3/2016 Johnson ..... B65B 11/025
9,677,633 B2 * 6/2017 Horner ..... F16D 49/10
10,299,439 B2 * 5/2019 Simmons ..... A01F 15/0715
10,721,870 B2 * 7/2020 Chapon ..... B65B 41/12
2002/0174628 A1 * 11/2002 Lancaster, III ..... B65B 11/025 53/441
2003/0145563 A1 * 8/2003 Cere' ..... B65B 11/025 53/588
2004/0031238 A1 * 2/2004 Cox ..... B65B 11/045 53/399
2005/0044812 A1 * 3/2005 Lancaster, III ..... B65B 11/02 53/399
2006/0248858 A1 * 11/2006 Lancaster, III ..... B65B 11/025 53/399
2006/0254225 A1 * 11/2006 Lancaster, III ..... B29C 55/06 53/556
2006/0289691 A1 * 12/2006 Forni ..... B65H 18/10 242/534
2007/0204564 A1 * 9/2007 Lancaster, III ..... B65B 11/006 53/399
2011/0088359 A1 * 4/2011 Brocard ..... B65B 11/025 53/461
2014/0250833 A1 * 9/2014 Piani ..... B65B 51/02 53/399
2018/0334274 A1 * 11/2018 Brizek ..... B65B 11/008

* cited by examiner

Fig. 4
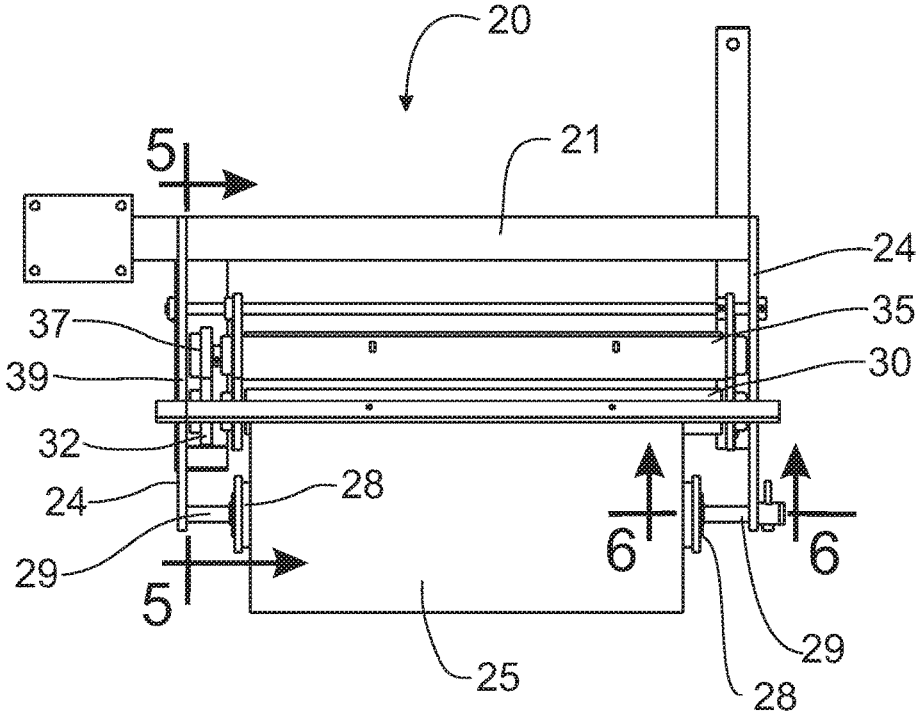
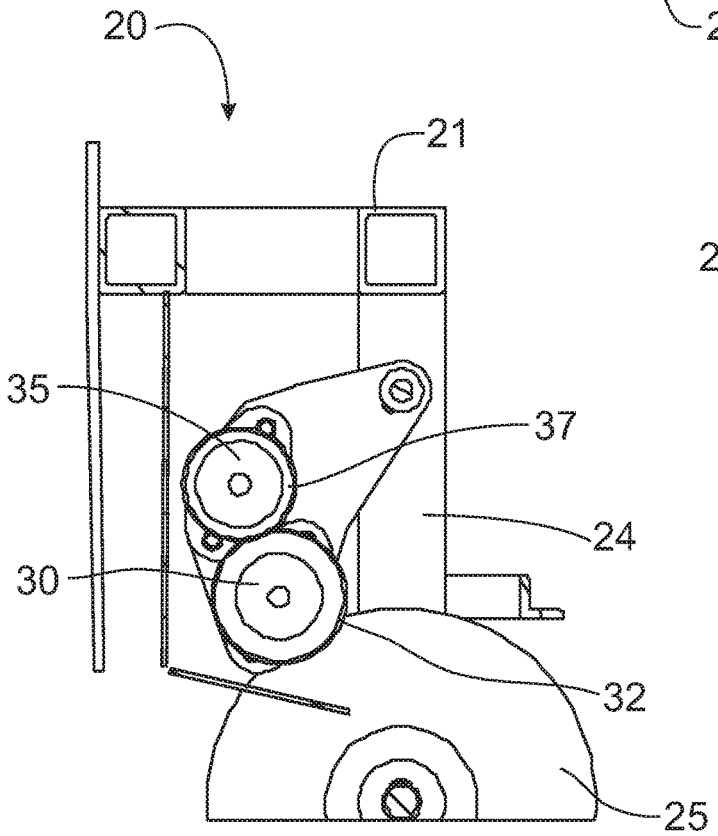
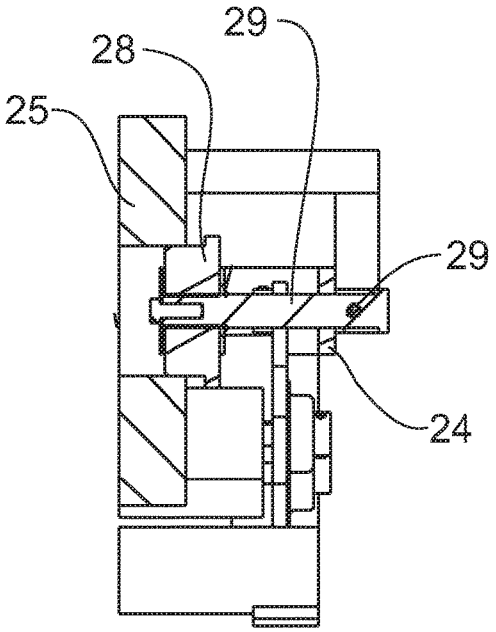
Fig. 5
Fig. 6

Fig. 9
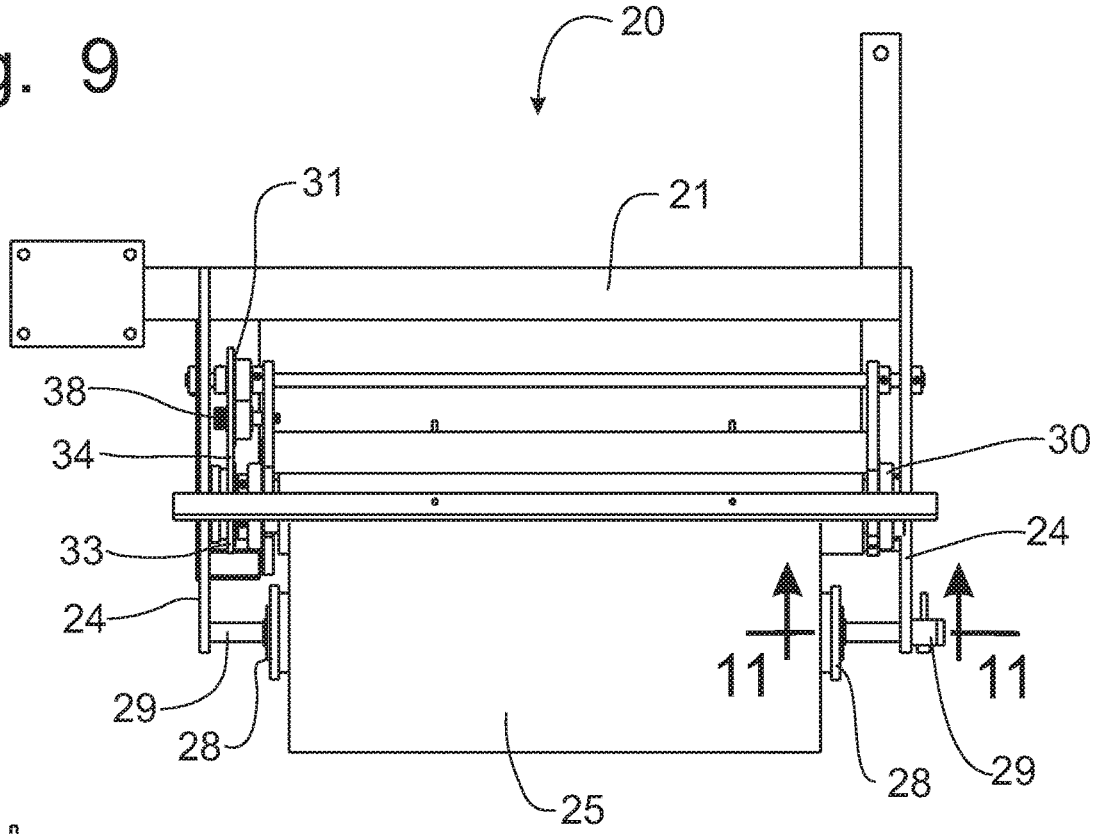
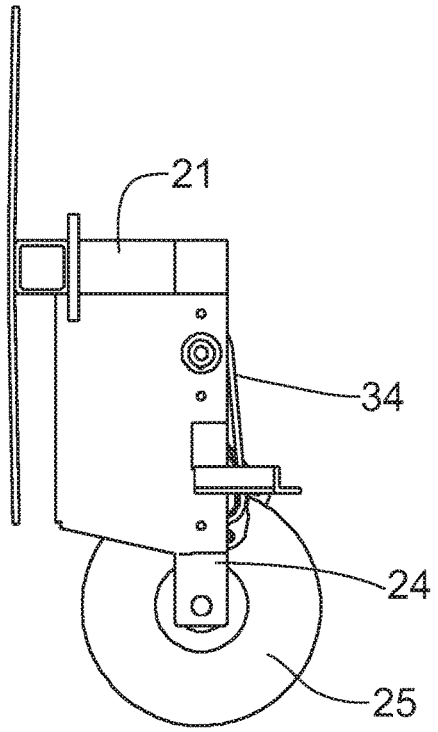
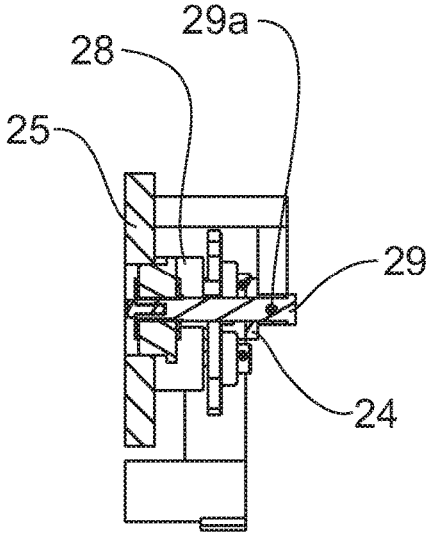
Fig. 10
Fig. 11

Fig. 14
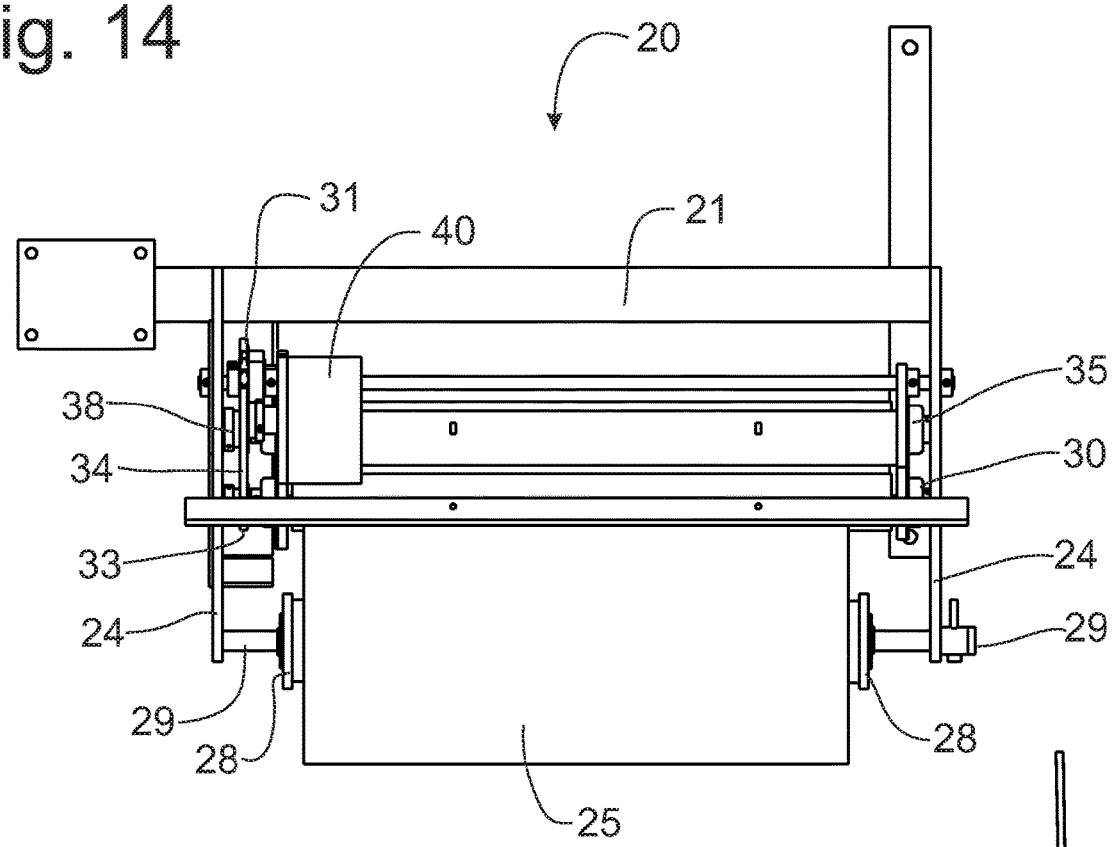
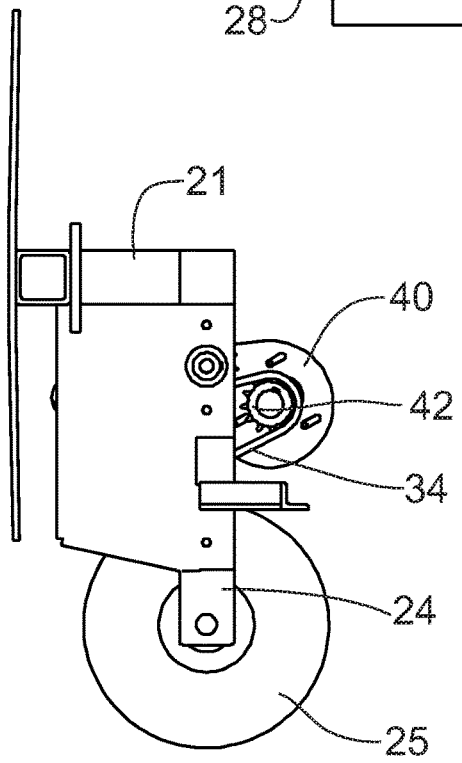
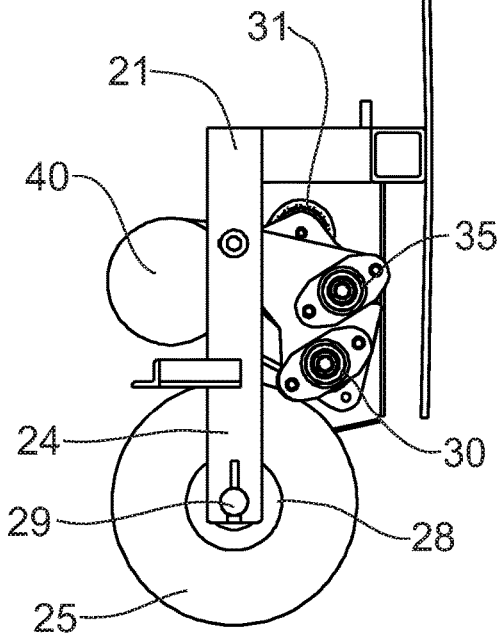
Fig. 15
Fig. 16

ORBITAL STRETCH WRAPPING APPARATUS

CROSS-REFERENCE TO RELATED APPLICATIONS

This application is a continuation of U.S. non-provisional patent application Ser. No. 13/919,132, filed on Jun. 17, 2013, which claims priority to U.S. Provisional Patent Application No. 61/661,112, filed on Jun. 18, 2012, the contents of which are incorporated herein by reference.

FIELD OF THE INVENTION

This invention relates generally to a wrapping apparatus and, more particularly, to an orbital stretch wrapping apparatus for packaging.

BACKGROUND OF THE INVENTION

Wrapping stretch film around a cargo before shipment has been utilized for many years. The plastic film binds the products into a stable, more secured load that can be easily shipped from the manufacturing source of the products to the end user. Generally, the wrapped cargo is sized to be placed onto a pallet that facilitates the handling of the cargo during transportation and during the movement from one location to another.

Stretch film wrapping devices have traditionally been utilized to place stretch film around the cargo on the pallet. To this end, some stretch film wrapping machines place the cargo onto a rotating turntable while the roll of plastic stretch film, which is oriented vertically, is held in a stationary position for the application of the stretch film as the cargo is rotated on the turntable. One such apparatus can be found in U.S. Pat. No. 4,299,076, granted on Nov. 10, 1981, to John R. Humphrey, in which the cargo is placed onto a pallet and then moved along a horizontal roller conveyor to reach the turntable where the plastic film is applied as the pallet and the load thereon is rotated about a vertical axis. Another such wrapping apparatus is found in U.S. Pat. No. 5,606,849, granted to Roger V. Bettenhausen on Mar. 4, 1997. The vertically oriented roll of plastic stretch film is vertically movable to facilitate the application of the stretch film to the entire vertically oriented faces of the palletized cargo as the turntable is rotated.

Another more commonly found configuration of the stretch film wrapping system has the cargo placed on the pallet which is held in a stationary position while the wrapping apparatus rotates around the cargo to apply plastic stretch film to the vertically oriented faces of the palletized cargo. One example of such a wrapping machine can be found in U.S. Pat. No. 6,253,532, issued on Jul. 3, 2001, to Kenneth S. E. Orpen, in which the vertically oriented roll of plastic stretch film is carried on an arm that is rotated about a vertical axis of rotation carried by the apparatus and positioned over top of the cargo to be wrapped. In the Orpen wrapper apparatus, the cargo is anticipated to be in a cylindrical shape which is also rotated about a horizontal axis while the plastic stretch film is being applied to the cargo. The end result is that the entire cylindrical object is wrapped with the plastic stretch film. Such wrapping devices are commonly found in the agricultural industry to wrap cylindrical bales of hay or other organic material to create an airtight seal that converts the organic material into a silage product.

A variation of the stretch film wrapping machines having vertically oriented rolls of stretch film can be found in U.S. Pat. No. 7,581,368, granted to Darrel Bison on Sep. 1, 2009, and in U.S. Pat. No. 8,037,660, issued to Patrick R. Lancaster, III, et al, on Oct. 18, 2011. In these alternative wrapping machines, the plastic is applied as a rope that is passed around the vertically oriented faces of the cargo being secured and stabilized thereby. For some forms of cargo to be wrapped into a stabile shippable configuration, the consolidation of the stretch film into a rope configuration provides adequate stabilization of the cargo.

An orbital variation of the plastic stretch film wrapping system can be found in U.S. Pat. No. 4,723,393, issued on Feb. 9, 1988 to Peter Silbernagel, wherein the plastic stretch film is applied around the cargo from a generally horizontally oriented roll of stretch film that is passed vertically around the cargo to be stabilized for shipment. In the '393 patent, the cargo being wrapped in plastic is wrapped while being passed through the center of the wrapping mechanism, the wrapped cargo being subsequently shipped with or without the use of a pallet. The orbital wrapping mechanism is operated within a gap formed in a horizontal conveyor along which the cargo is passed to be wrapped in stretch film.

The orbital stretch wrapping apparatus shown in U.S. Pat. No. 6,564,532, issued to Robert J. Gutche on May 20, 2003, has the horizontally oriented roll of stretch film mounted on an arm that is rotated about the cargo and pallet being wrapped in plastic. The wrapping mechanism in the '532 patent is configured substantially like the vertical axis wrappers as depicted in U.S. Pat. No. 6,253,532, except oriented with the axis of rotation of the arm carrying the roll of plastic stretch film being positioned horizontally. A significant difference between the orbital stretch wrapping apparatus shown in U.S. Pat. No. 4,723,393 and the wrapping mechanism shown in U.S. Pat. No. 6,564,532 is that the apparatus in U.S. Pat. No. 6,564,532 wraps stretch film around both the cargo and the pallet on which the cargo is situated.

A commercially available stretch film wrapping system of the orbital configuration is marketed under the brand of "Yellow Jacket". This "Yellow Jacket" orbital wrapping mechanism has a base frame supporting a cylindrical wrapping mechanism that is linearly movable along the base frame. Within the cylindrical wrapping mechanism is an orbital wrapper that carries a roll of plastic stretch film positioned horizontally. The plastic roll is then driven around the cylindrical wrapping mechanism to dispense plastic stretch film around the cargo and the pallet on which the cargo is mounted. Typically, the pallet bearing the cargo is carried by a forklift in a manner that the cargo bearing pallet is positioned in the center of the cylindrical wrapping mechanism. The orbital drive is actuated to spin the roll of plastic stretch film around cargo and pallet and apply the stretch film thereto. The cylindrical wrapping mechanism is then moved along the base frame so that the plastic stretch film is applied along the entire longitudinal length of the cargo and pallet. The end result is that the cargo is secured directly to the pallet to provide stability and security to the wrapped cargo.

One of the difficulties in applying plastic stretch film around the cargo, whether or not the pallet is wrapped in plastic stretch film with the cargo, is that the stretch film is not placed in tension as the stretch film is being applied to the cargo. Although an adequate number of layers of the plastic film will ultimately resolve the stability problem inherent with a loose application of the stretch film to the cargo, more plastic stretch film is applied than is necessary to provide proper stability and security to the wrapped cargo.

Thus, it would be desirable to provide a plastic stretch wrap dispensing mechanism that would place tension on the stretch film as the plastic stretch film is being applied to the cargo. The end result is that less plastic stretch film would be required to stabilize a cargo being wrapped and less time would be needed to apply the stretch film to wrap and stabilize a cargo for shipment.

It would also be desirable to provide an orbital stretch film wrapping machine that is less expensive to manufacture while providing the end results of a wrapped, stabilized cargo bearing pallet.

SUMMARY OF THE INVENTION

It is an object of this invention to overcome the disadvantages of the known prior art by providing an orbital stretch film wrapping system. An orbital stretch wrapping apparatus is provided and includes a base frame, a circular ring mounted on the base frame and rotatable with respect to the base frame about an axis of rotation, a stretch film dispenser mounted on the circular ring and rotatable with the circular ring about the axis of rotation, the stretch film dispenser having a subframe fixed to the circular ring, a roll of stretch film mounted to the subframe, a first feed roller mounted to the subframe, a second feed roller mounted to the subframe, and a brake member connected to the first feed roller and the second feed roller. The stretch film dispenser, the first feed roller, and the second feed roller are rotatable with respect to the subframe.

BRIEF DESCRIPTION OF THE DRAWINGS

The advantages of this invention will become apparent upon consideration of the following detailed disclosure of the invention, especially when taken in conjunction with the accompanying drawings wherein:

FIG. 4 is a rear elevational view of the dispensing apparatus shown in FIG. 4;

FIG. 5 is a cross-sectional view of the dispensing apparatus corresponding to lines 5-5 of FIG. 4 to shown the intermeshing gears of the two feed rollers;

FIG. 6 is a partial cross-sectional view of the end cap for the roll of stretch film to depict the rotational mounting thereof corresponding to lines 6-6 of FIG. 4;

FIG. 9 is a rear elevational view of the dispensing apparatus shown in FIG. 7;

FIG. 10 is a right side elevational view of the dispensing apparatus shown in FIG. 9;

FIG. 11 is a partial cross-sectional view of the end cap for the roll of stretch film to depict the rotational mounting thereof corresponding to lines 11-11 of FIG. 9;

FIG. 14 is a rear elevational view of the dispensing apparatus shown in FIG. 12;

FIG. 15 is a right side elevational view of the dispensing apparatus shown in FIG. 14;

FIG. 16 is left side elevational view of the dispensing apparatus shown in FIG. 14;

DETAILED DESCRIPTION OF THE EMBODIMENTS

Figure 1:
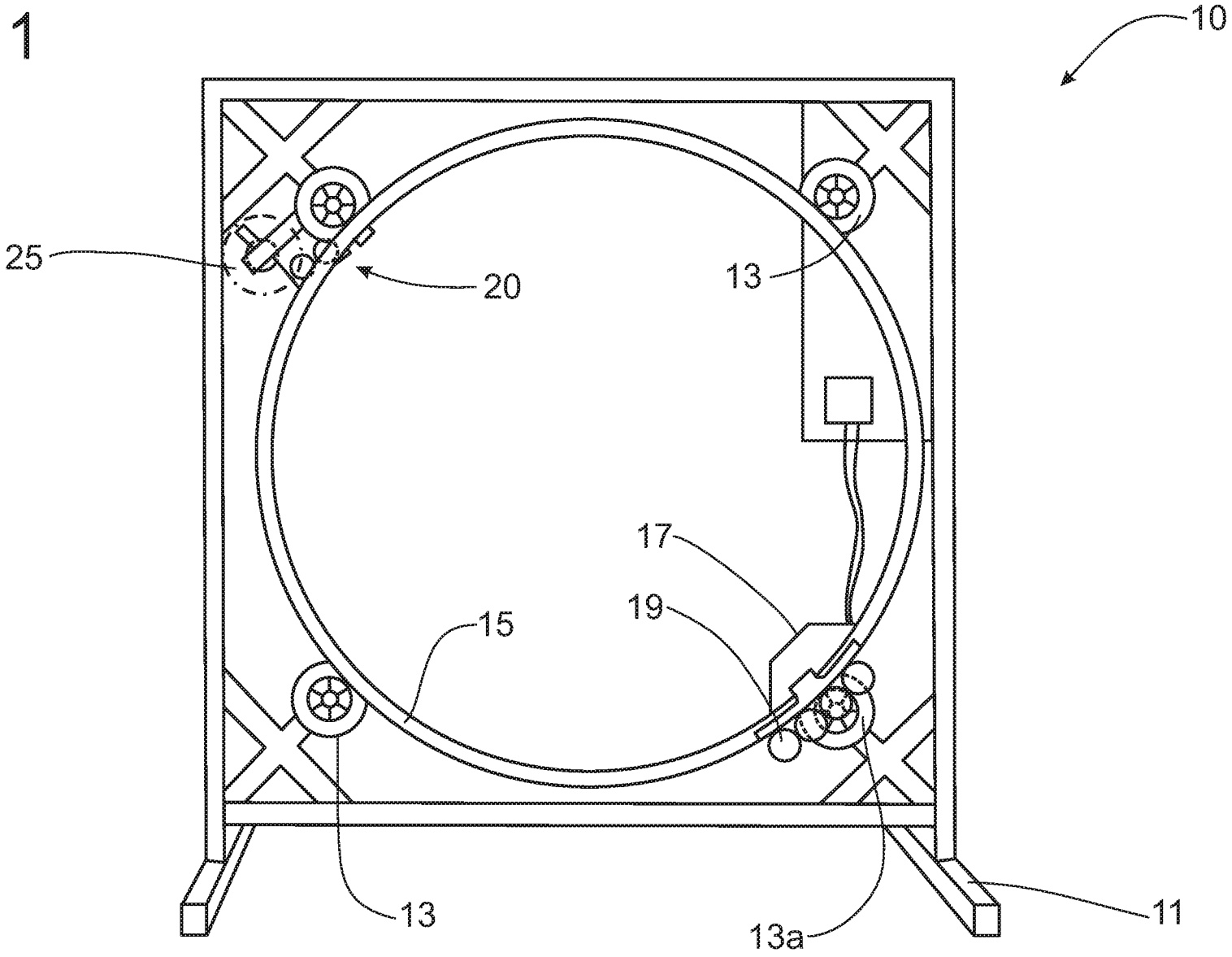
FIG. 1 is a schematic front elevational view of an orbital stretch film wrapping system incorporating the principles of the instant invention, the safety guards being deleted from the drawing for purposes of clarity, the stretch film dispensing apparatus being shown in the upper right quadrant of the elevational view.

Referring first to FIG. 1, a stretch film wrapping system incorporating the principles of the instant invention can best be seen. The orbital stretch wrapping apparatus 10 is formed with a base frame 11 operable to support the wrapper apparatus 10 on a floor surface. The base frame 11 supports a circular ring 15 that is rotationally mounted on the base frame 11. A plurality of rotational supports 13, preferably in the form of rubber tires, are mounted on the base frame 11 to rotatably support the circular ring 15. Preferably, one rotational support 13 is located at each corner of the base frame 11 mounted on a gusset spanning across the corner of the base frame 11. Three of the rubber tires 13 are idlers that simply support the rotational movement of the circular ring 15. The fourth rubber tire 13*a* is rotatably driven by an electrical motor 17 to power the rotation of the circular ring 15.

A stretch film dispenser 20 is mounted in a cantilevered manner on the circular ring 15 so as to not interfere with the rotational support of the circular ring 15 by the rubber tires 13, 13*a*. A counterweight 19 is also mounted on the circular ring 15 diametrically opposite the mounting of the stretch film dispenser 20 so that the rotation of the circular ring 15 with the stretch film dispenser 20 mounted thereon can be balanced. Alternatively, a second stretch film dispenser could be supported on the circular ring 15 in diametric opposition to the first stretch film dispenser 20 instead of the counterweight 19.

The circular ring 15 carrying the stretch film dispenser 20 is powered to rotate relative to the base frame 11. The circular ring 15 does not move longitudinally relative to the base frame 11; therefore, the stretch film supplied by the stretch film dispenser 20, as will be described in greater detail below, will only be applied in a single swath to the cargo inserted into the wrapping apparatus 10. Thus, the construction of the wrapping apparatus 10 is substantially simplified without providing a track on the base frame 11 that would support a longitudinal movement of the circular ring 15 in order to apply the stretch film to the cargo in longitudinally spaced swaths or in a spiral manner. The application of stretch film to the cargo to be wrapped can be accomplished by moving the cargo relative to the circular ring 15, as will be described in greater detail below.

Figure 2:
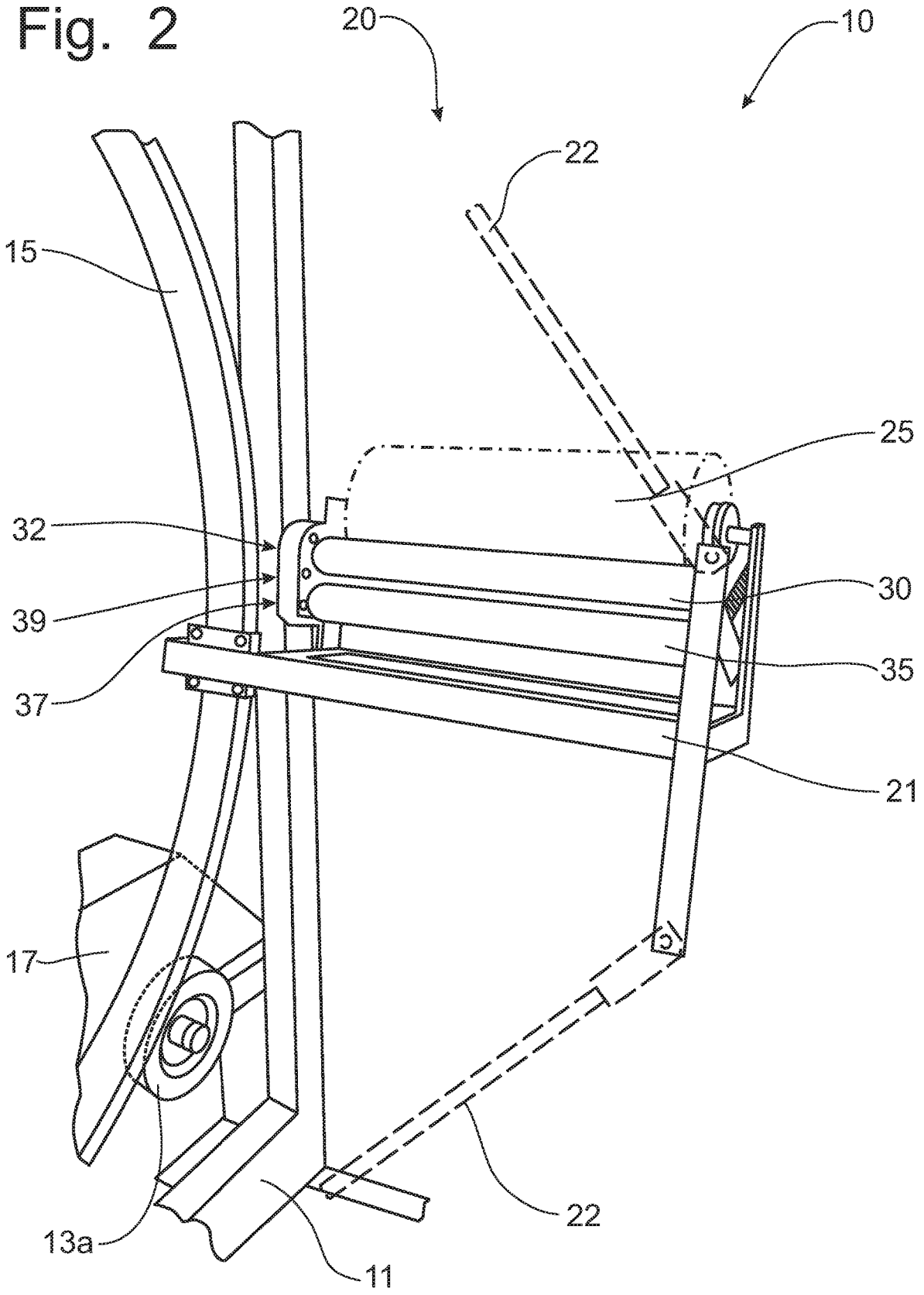
FIG. 2 is a schematic perspective view of the dispensing apparatus of the orbital stretch film wrapping system shown in FIG. 1 for applying stretch film to a cargo supported on a pallet.
Figure 3:
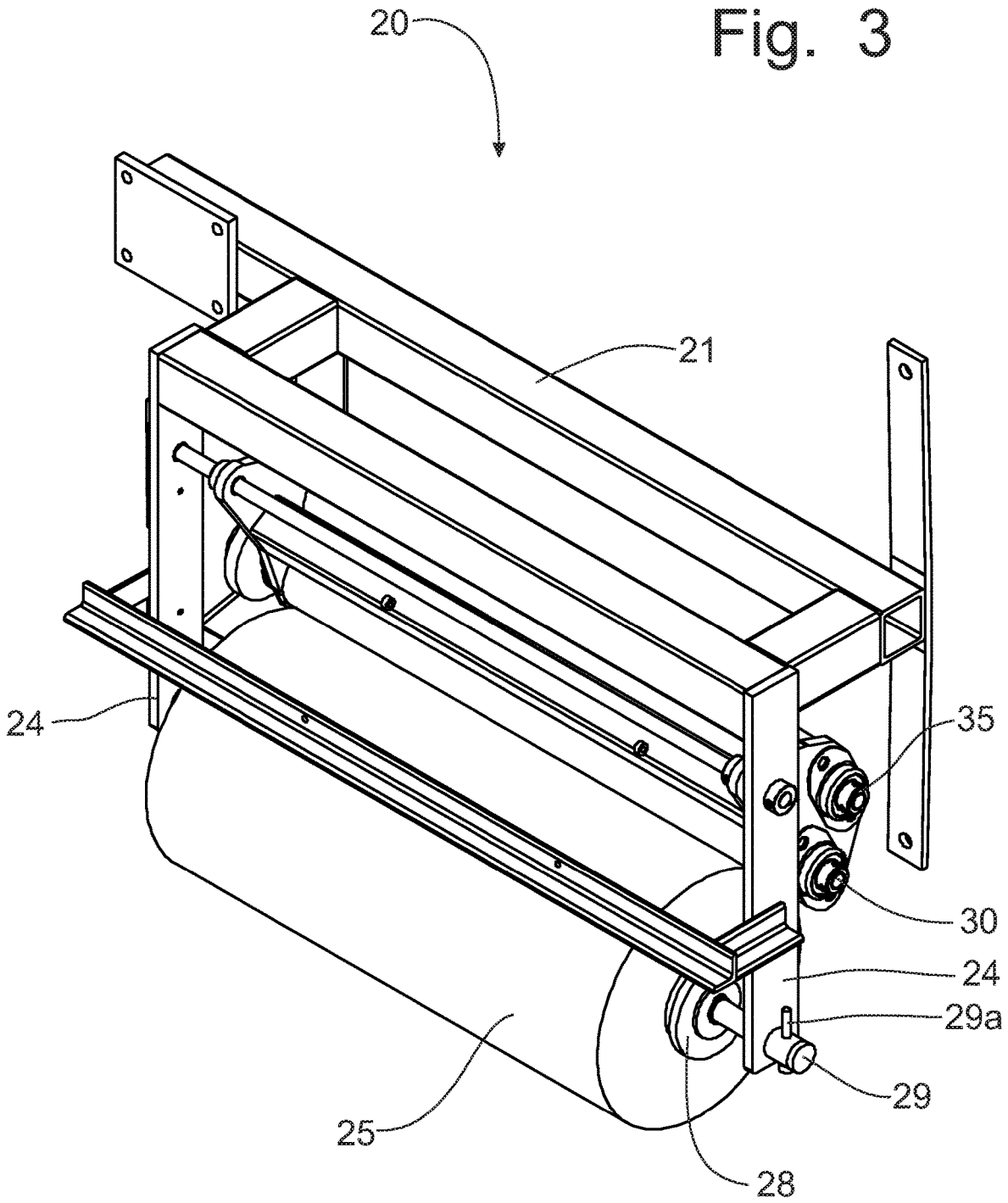
FIG. 3 is a back side perspective view of a first embodiment of the dispensing apparatus utilizing intermeshing gears for use on a wrapping mechanism such as depicted in FIG. 1.
Figure 7:
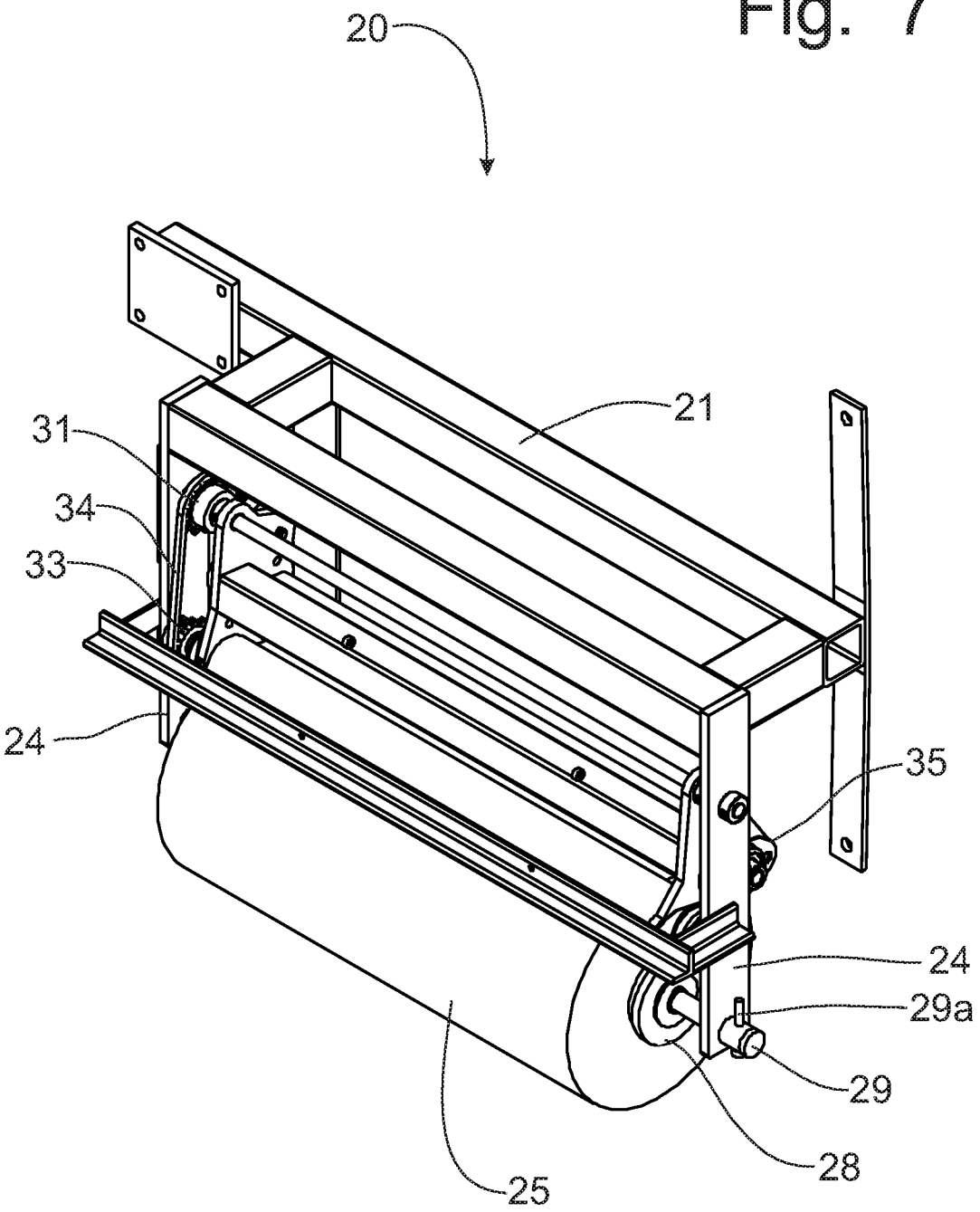
FIG. 7 is a left rear side perspective view similar to that of FIG. 3, but depicting a second embodiment of the dispensing apparatus utilizing a chain drive interconnecting the feed rolls for use on a wrapping mechanism such as depicted in FIG. 1.
Figure 8:
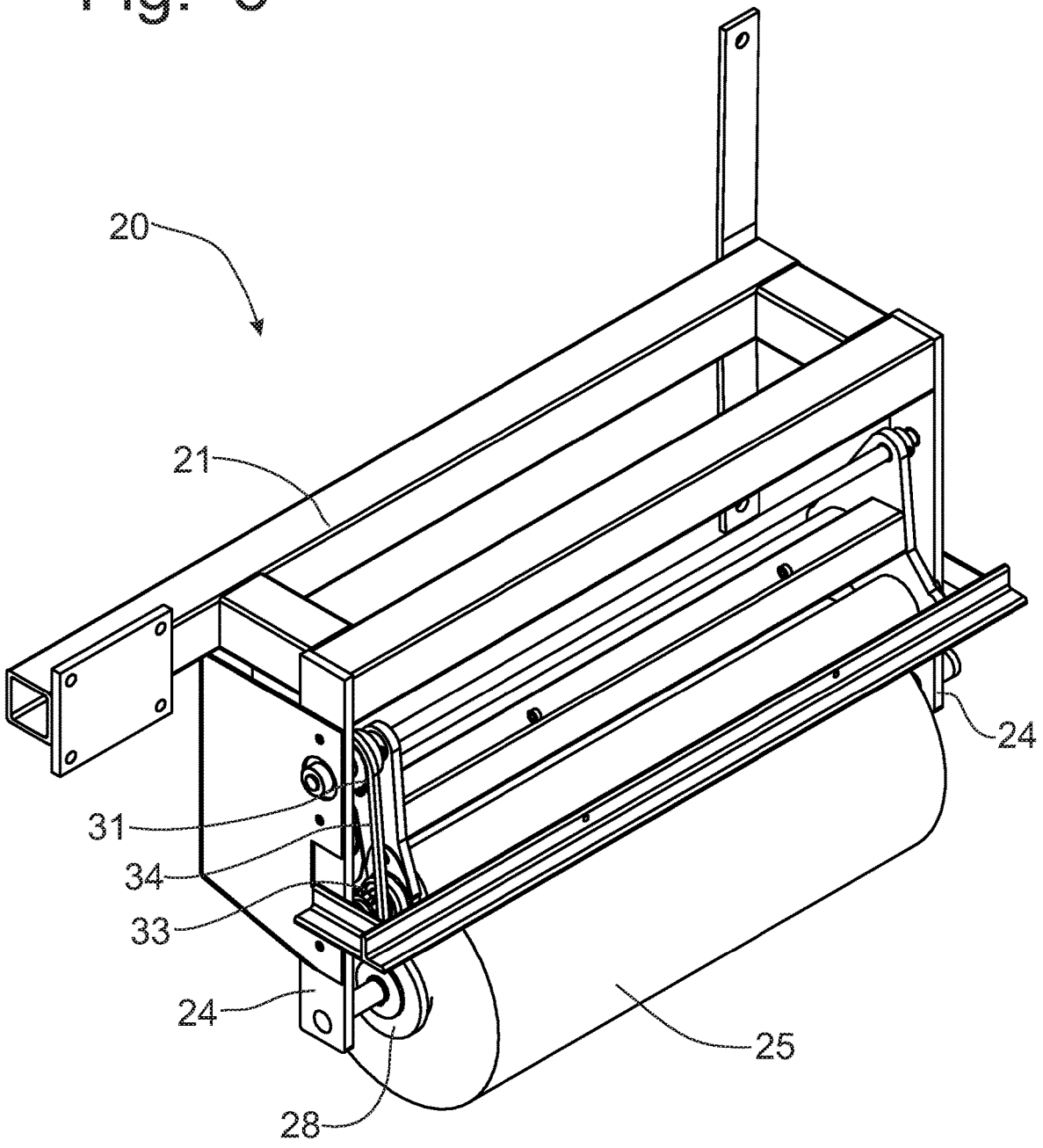
FIG. 8 is a right rear perspective view of the dispensing apparatus depicted in FIG. 7.
Figure 12:
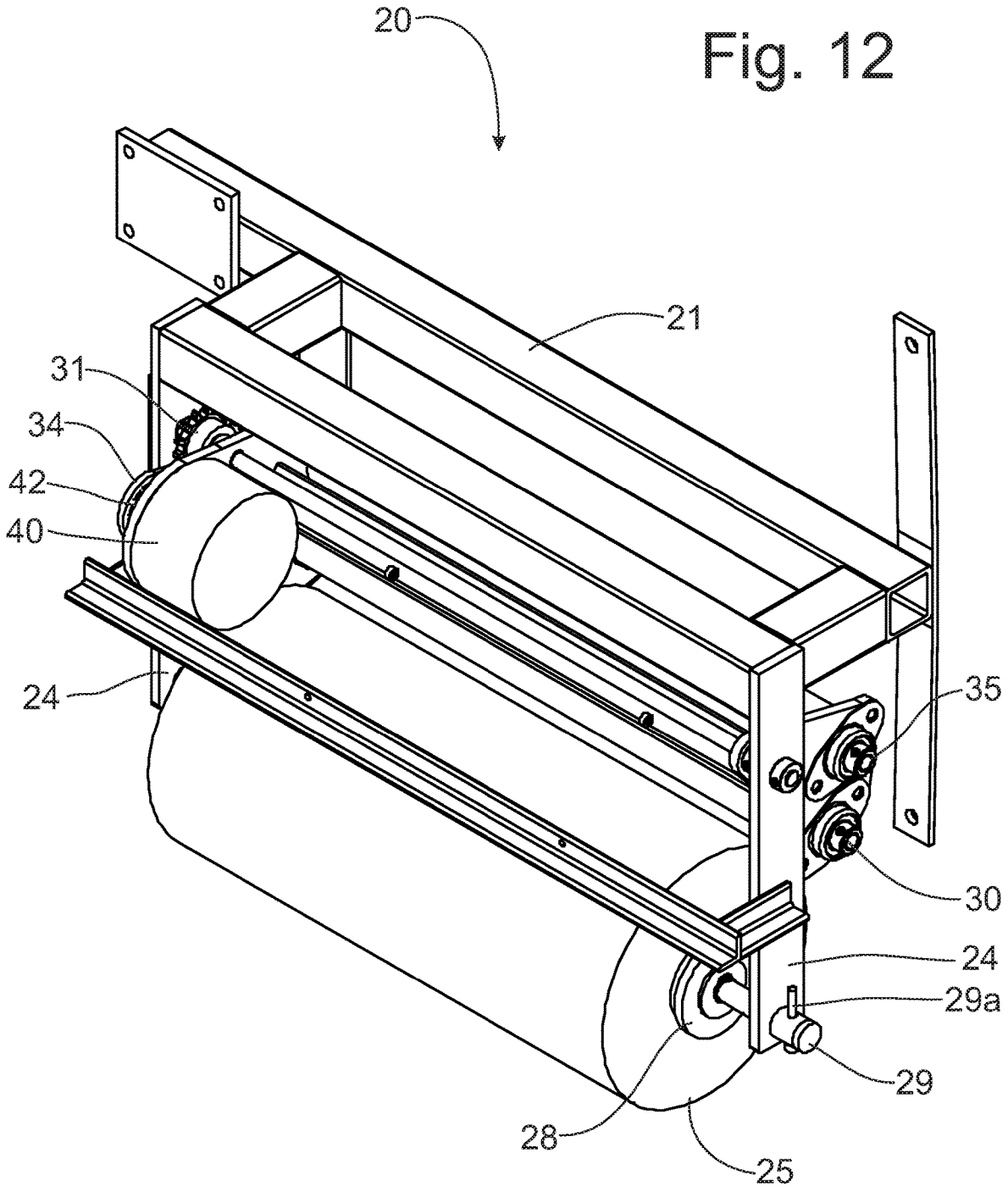
FIG. 12 is a left rear side perspective view similar to that of FIGS. 3 and 7, but depicting a third embodiment of the dispensing apparatus utilizing a chain drive interconnecting the feed rolls and a braking device for use on a wrapping mechanism such as depicted in FIG. 1.
Figure 13:
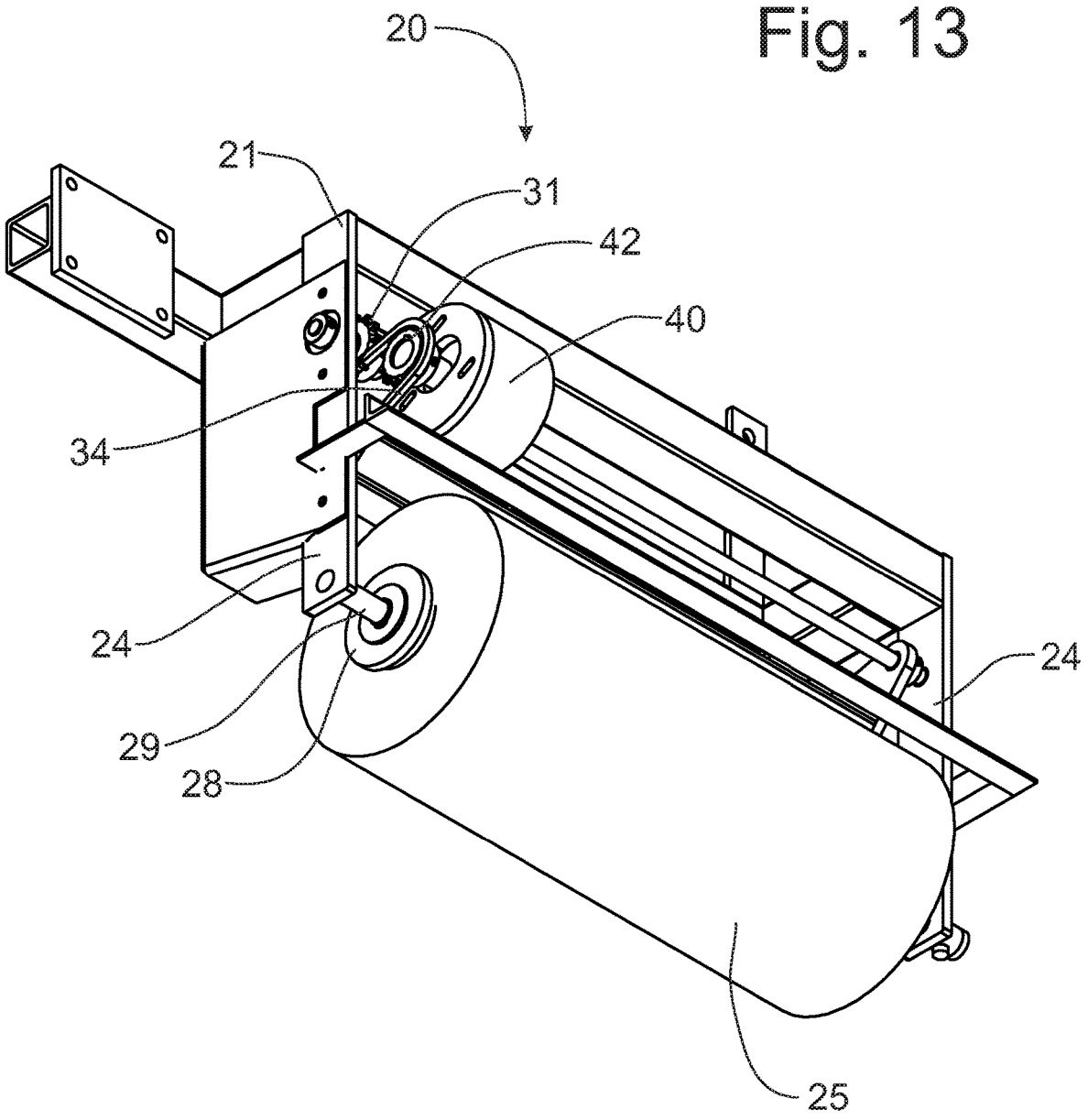
FIG. 13 is a lower right rear perspective view of the dispensing apparatus depicted in FIG. 12.

The stretch film dispenser 20 is best seen in FIGS. 2-4. The dispenser 20 includes a subframe 21 secured to the circular ring 15 in an offset or cantilevered orientation. The subframe 21 can be stabilized by a pair of optional stabilizing rods 22 that are attached to the remote end of the subframe 21 and then to the circular ring on opposite sides of the subframe 21 in a manner that will not interfere with the support of the exterior surface of the circular ring 15 on the rubber tires 13, 13*a*. The subframe 21 rotatably supports the roll of stretch film 25, such as by a shaft 27 that extends through the core of the roll of stretch film 25 or through the application of end caps 28 as described in greater detail below. The subframe 21 also rotatably supports first and second feed rollers 30, 35 in proximity to the roll of stretch film 25 to receive the stretch film from the roll 25. Preferably, the feed rollers 30, 35 have the same diameter and are formed of a relatively soft rubber or neoprene.

Referring now to the first embodiment of the stretch film dispenser 20 shown in FIGS. 3-6, each of the two feed rollers 30, 35 have at one end thereof a gear 32, 37. The two gears 32, 37 are meshed with one another within a casing 39 to control the differential speed of the associated rollers 30, 35. The first feed roller 30, which is the feed roller that is physically closest to the roll of stretch film 25, has a larger gear 32 than the gear 37 at the end of the second feed roller 35, as is best seen in FIG. 5. The relative sizes of the two gears 32, 37 are such that the first feed roller 30 rotates approximately 45% slower than the second feed roller 35. The end result is that the stretch film wrapped from the supply roll 25 around the first roller 30 and then back wrapped around the second roller 35, as is reflected by the arrows in FIG. 17, has a tension induced thereon during the application of the stretch film to the cargo placed at the center of the rotatable circular ring 15.

One skilled in the art will recognize that the two feed rollers 30, 35 are not powered in rotation. The rotation of the feed rollers 30, 35 is caused by the wrapping of the stretch film around the cargo as the circular ring 15 rotates spinning the dispenser 20 around the cargo to apply the stretch film thereto. The pulling of the stretch film against the second roller 35 as the dispenser 20 is rotated with the circular ring 15 around the cargo causes the second roller 35 to rotate. The intermeshed gears 32, 37, transfer the rotational movement of the second roller 35 to the first roller 30. The relative differential speeds of rotation of the first and second rollers 30, 35 induce tension into the stretch film as the stretch film is unrolled from the supply roll 25.

As best seen in FIG. 6, the roll 25 of stretch film is preferably mounted on a pair of end caps 28 positioned at each opposing end of the roll 25, although only one of the end caps 28 is depicted in FIG. 6. Each end cap 28 is mounted on a stub axle 29 that is supported in a mounting flange 24 forming part of the subframe 21. A pin 29*a* engaged in at least one of the stub axles 29 retains the stub axles 29 and associated end caps 28 in position on the subframe 21 to dispense a supply of stretch film from the roll 25 around the feed rollers 30, 35 to the cargo being wrapped. The end caps 28 are simply plugged into the opposing ends of the carrier tube (not shown) on which the stretch film is wrapped and retained there by friction and an inability to move laterally due to receipt of the stub axles 28 into the mounting flanges 24.

Figure 17:
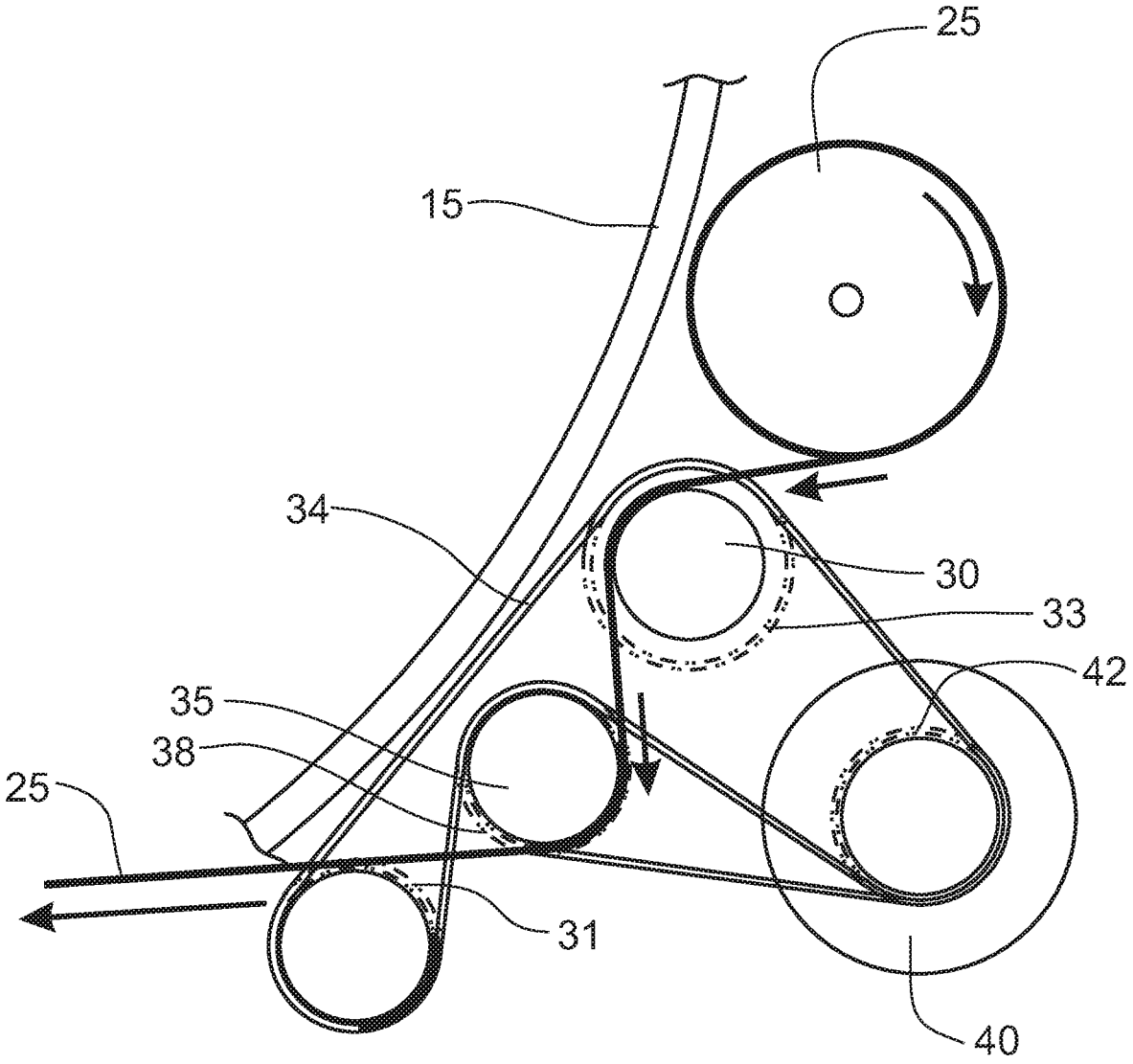
FIG. 17 is a schematic drive diagram of the stretch film dispensing apparatus shown in FIGS. 12-16.
Figure 18:
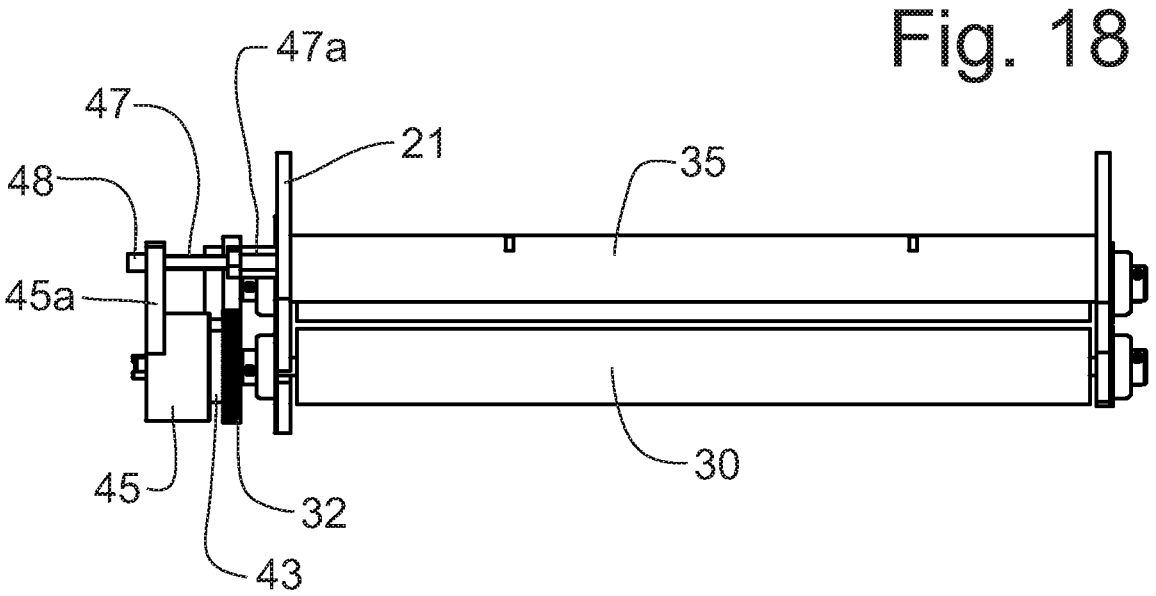
FIG. 18 is a rear elevational view of the feed roller assembly portion of the dispensing apparatus incorporating a manually adjustable braking device.

Referring now to FIGS. 7-11, a second embodiment of the stretch film dispenser 20 can be seen. The primary difference between the first embodiment of the stretch film dispenser 20 depicted in FIGS. 3-6 and the second embodiment of the stretch film dispenser 20 in FIGS. 7-11 is the manner in which the first feed roll 30 is driven from the second feed roll 35. In the second embodiment shown in FIGS. 7-11, the corresponding ends of the feed rolls 30, 35 have mounted thereon sprockets 33, 38, instead of intermeshed gears 32, 39. The sprockets 33, 38 are entrained by an endless chain 34 that transfers rotational motion from the second feed roll 35 to the first feed roll 30. The chain 34 requires a tensioning idler 31, which can be in the form of a positionable curved block 31*a* as depicted in FIG. 17, or as a separate idler sprocket 31*b* rotatably mounted on the subframe 21, to engage the chain 34 and maintain tension therein.

Referring now to the third embodiment of the stretch film dispenser 20 shown in FIGS. 12-16, a brake member 40 is added to the dispenser 20 to further restrict the movement of the stretch film from the roll 25 of stretch film around the two feed rolls 30, 35 and onto the cargo to be wrapped. The brake member 40 carries a sprocket 42 that is entrained by the chain 34 along with the sprockets 33, 38 on the two feed rolls 30, 35 and the tensioning idler 31 so that the movement of the chain 34 around the sprockets 33, 38, 31 and 42, is restricted by the brake member 40 which applies a drag on the chain 34. The use of the brake member 40 can allow the sprockets 33, 38 on the feed rolls 30, 35 to be the same size, as differential speed of the respective rollers 30, 35 is no longer needed as the brake member 40 will provide the necessary tension in the stretch wrap as the dispenser 20 is rotated about the circular ring 15. Preferably, the brake member 40 will be operatively adjustable in a known manner to vary the resistance imparted by the brake member 40 in the application of the stretch film to the cargo.

Figure 19:
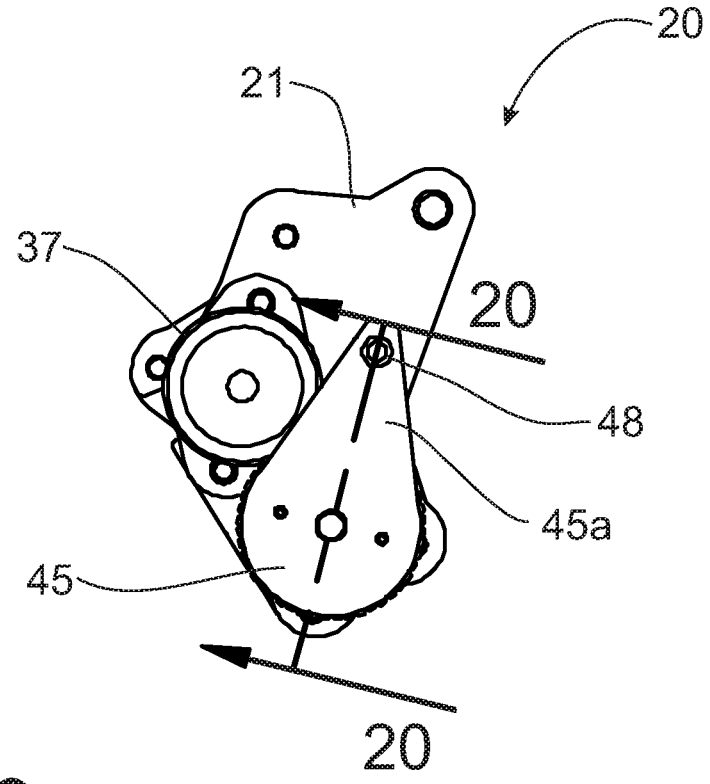
FIG. 19 is a right side elevational view of the feed roller assembly shown in FIG. 18.
Figure 20:
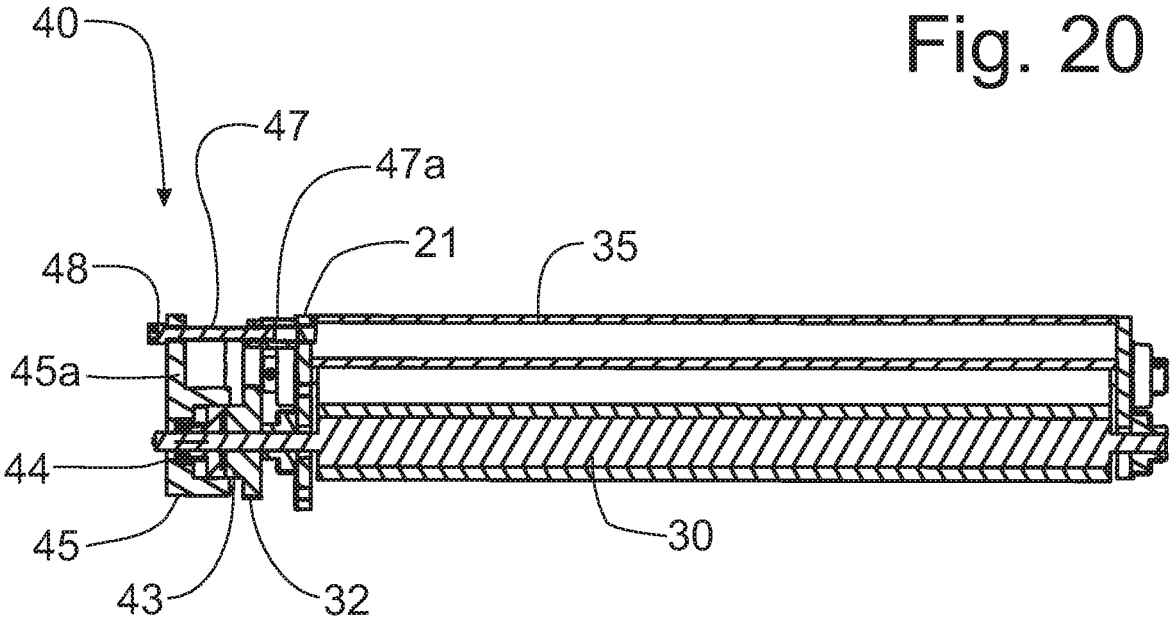
FIG. 20 is a cross-sectional view through the feed roller assembly taken along lines 20-20 of FIG. 19.
Figure 21:
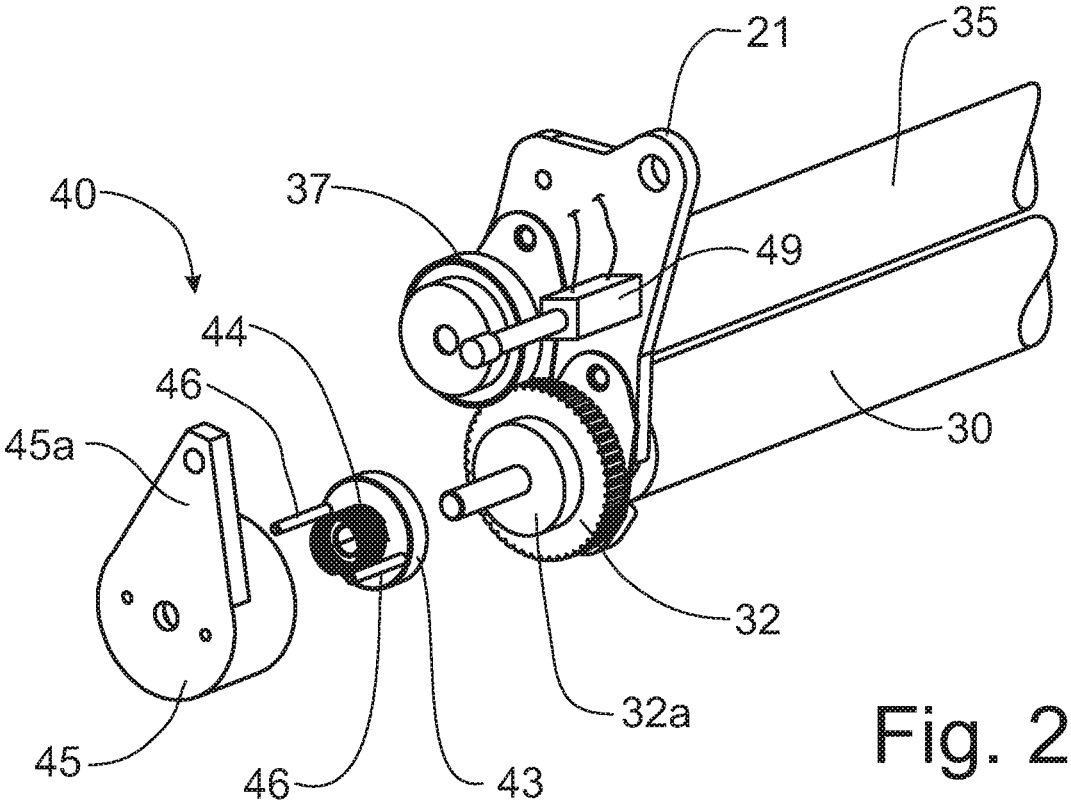
FIG. 21 is a partial perspective, exploded view of the feed roll assembly similar to that of FIG. 18, but depicting a remotely controlled actuator for adjusting the tension applied by the braking device.

A manually adjustable brake member 40 is depicted in FIGS. 19-21. The gear 32 is modified to include a rotor portion 32*a* against which a braking disc 43 presses into engagement to restrict the rotation of the gear 32. The braking disc 43 is biased against the rotor portion 32*a* by s compression spring 44 that is contained by a spring housing member 45 received on a pair of guide pins 46 supported on the braking disc 43. The spring housing 45 is movable along the guide pins 46 to selectively vary the compression on the spring 44, and thus the spring force exerted by the spring 44 onto the braking disc 43. The position of the spring housing 45 is controlled by the adjustment rod 47 that has a head portion 48 capturing an actuation arm 45*a* on the spring housing 45. The adjustment rod 47 is treaded into a mount 47*a* supported on the subframe 21 to allow the adjustment rod 48 to move relative to the mount 47*a*.

In operation, the amount of tension placed on the stretch film as the stretch film is being wrapped around the cargo is a function of the amount of spring force exerted by the spring 44 onto the braking disc 43 to engages the face of the rotor portion 32*a*. The compression of the spring 44 is controlled by moving the adjustment rod 47 into or outwardly of the mount 47*a*, as this movement controls the positioning of the spring housing 45 along the guide pins 46. A selective movement of the adjustment rod 47 can be accomplished by utilizing an Allen wrench (not shown) or socket wrench (not shown) to engage the head 48 and cause rotation thereof.

In FIG. 21, a variation of the manually adjustable braking device 40 can be seen. In lieu of an adjustment rod 47 threaded into a mount 47, the position of the spring housing 45 along the guide pins 46 can be controlled by a linear actuator 49 secured to the subframe 41 and connected to the actuation arm 45*a* for extension and retraction that moves the spring housing 45 along the guide pins 46. The linear actuator 49 is preferably electrically operated, and may be battery powered, to permit a remote control of the movement of the linear actuator 49, and the amount of tension asserted on the stretch film as the stretch film is applied to the cargo being wrapped. A remote controller (not shown) can vary the tension in the stretch wrap as the stretch wrap is being applied by increasing the spring force exerted by the spring 44 as a function of the number of revolutions of the stretch film dispenser 20 around the cargo being wrapped. As a result, the initial wraps of the stretch film can be applied to the cargo under low torque and then increase with each revolution or each increment of revolutions of the dispenser 20 around the cargo.

In operation, the pallet (not shown) having a cargo (not shown) supported thereon is lifted by a fork lift (not shown) with the tines inserted into the pallet in a conventional manner. The fork lift operator inserts the cargo bearing pallet into the center of the circular ring 15. The loose end of the stretch film is secured on the cargo and the electric motor 17 is started to drive the rotation of the drive wheel 13*a*. The drive wheel 13*a* rotates the circular ring 15 and rotates the stretch film dispenser 20 around the pallet and the cargo mounted thereon. As the stretch film dispenser 20 is rotated around the pallet and cargo, the fork lift operator advances the fork lift, and the pallet supported thereon further into the circular ring 15, thus advancing the cargo and pallet longitudinally relative to the longitudinally fixed circular ring 15 and the base frame 11.

The differentially rotated feed rollers 30, 35 of the stretch film dispenser 20 keep the stretch film taut as the stretch film is wrapped around the cargo and pallet. As a result, the cargo and pallet require less stretch film to stabilize the cargo on the pallet and the wrapping of the cargo and pallet. Accordingly, the process of wrapping a cargo and pallet for shipment will take less time to accomplish. Furthermore, since the base frame 11 of the wrapping apparatus 10 does not have a track to enable the longitudinal movement of the circular ring relative to the cargo, the wrapping apparatus can be manufactured less expensively. When the cargo and pallet have been wrapped adequately with the stretch film to stabilize the cargo on the pallet, the stretch film is severed and the fork lift operator withdraws the wrapped pallet and cargo for subsequent shipping. One skilled in the art will note that the stretch film is wrapped in an orbital manner around both the pallet and the cargo, thus securing the cargo to the pallet and providing a highly stabilized package for shipment. In the third embodiment of the stretch film dispenser 20, as described above, the brake member 40 will maintain tension in the stretch film as the stretch film is being wrapped around the cargo to be shipped.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

What is claimed is:

1. An orbital stretch wrapping apparatus, comprising:
a base frame;
a circular ring mounted on the base frame and rotatable with respect to the base frame about an axis of rotation;
a stretch film dispenser:
(a) mounted on the circular ring,
(b) rotatable with the circular ring about the axis of rotation, and
(c) having:
(1) a subframe fixed to the circular ring, and
(2) a roll of stretch film:
(i) mounted to the subframe,
(ii) rotatable with respect to the subframe, and
(iii) being a continuous piece of the stretch film,
(d) a first feed roller:
(1) mounted to the subframe,
(2) rotatable with respect to the subframe,
(3) engaging the stretch film of the roll of stretch film, and
(4) rotating at a roller speed during rotation of the circular ring at a set speed,
(d) a second feed roller:
(1) mounted to the subframe,
(2) rotatable with respect to the subframe,
(3) engaging the stretch film of the roll of stretch film, and
(4) rotating at the roller speed during rotation of the circular ring at the set speed; and
a brake member:
(a) connected to the first feed roller and the second feed roller,
(b) capable of adjusting the roller speed while the circular ring rotates at the set speed,
(c) having a braking disc pressed with a varying force against a rotor portion of the first feed roller to adjust the roller speed, and
(d) having a spring housing containing a compression spring disposed on a pair of guide pins attached to the braking disc biasing the braking disc against the rotor portion.

2. The orbital stretch wrapping apparatus of claim 1, wherein the spring housing is movable along the guide pins to selectively vary a compression on the compression spring, thereby varying a spring force exerted by the compression spring on the braking disc.

3. The orbital stretch wrapping apparatus of claim 2, wherein the brake member includes an adjustment rod adapted to move the spring housing along the guide pins.

4. The orbital stretch wrapping apparatus of claim 3, wherein the adjustment rod includes a mount attached to the subframe and a head portion attached to an actuation arm of the spring housing.

5. The orbital stretch wrapping apparatus of claim 4, wherein the adjustment rod is moved inwardly or outwardly of the mount and with respect to the subframe to control a position of the spring housing along the guide pins.

6. The orbital stretch wrapping apparatus of claim 5, wherein the adjustment rod is moved manually by rotation of the head portion.

7. The orbital stretch wrapping apparatus of claim 2, wherein the brake member includes a linear actuator adapted to move the spring housing along the guide pins, the linear actuator is electrically actuated.

8. The orbital stretch wrapping apparatus of claim 7, wherein the linear actuator is attached to the subframe and an actuation arm of the spring housing, and the linear actuator is moved inwardly or outwardly with respect to the subframe to control a position of the spring housing along the guide pins.

9. The orbital stretch wrapping apparatus of claim 8, wherein the linear actuator is moved electronically by a remote controller.

10. The orbital stretch wrapping apparatus of claim 9, wherein the remote controller varies a tension in the stretch film based on a number of revolutions of the stretch film dispenser around the cargo.

11. The orbital stretch wrapping apparatus of claim 1, wherein the stretch film is wrapped around the cargo by rotation of the circular ring at the set speed driven by a drive wheel, the first feed roller and the second feed roller driven to rotate only by wrapping of the stretch film around the cargo via rotation of the circular ring driven by the drive wheel.

* * * * *